US006230603B1

(12) United States Patent
Kubala

(10) Patent No.: US 6,230,603 B1
(45) **Date of Patent: *May 15, 2001**

(54) CUTTING BLADE FOR RESISTANCE-HEATED ELASTOMER CUTTERS

(76) Inventor: Zbigniew Kubala, 11415 Edgewood, Waukegan, IL (US) 60087

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/639,768

(22) Filed: Apr. 29, 1996

(51) Int. Cl.[7] ..... B26D 7/10
(52) U.S. Cl. ..... 83/875; 83/171
(58) Field of Search ..... 83/171, 875, 16; 30/140; 219/68, 233

(56) References Cited

U.S. PATENT DOCUMENTS

| | | | | |
|---|---|---|---|---|
| 1,127,665 | * | 2/1915 | Murphy | 219/233 |
| 1,834,555 | * | 12/1931 | Tittle | 219/233 X |
| 2,012,938 | * | 9/1935 | Beuoy | 219/233 |
| 2,157,151 | * | 5/1939 | Stackhouse | 83/171 X |
| 2,359,393 | * | 10/1944 | Sloan | 219/233 |
| 2,699,485 | * | 1/1955 | Wolf | 219/233 X |
| 3,054,441 | * | 9/1962 | Gex et al. | 83/171 X |
| 3,768,482 | * | 10/1973 | Shaw | 219/233 X |
| 4,501,951 | * | 2/1985 | Benin et al. | 83/171 X |
| 4,653,362 | * | 3/1987 | Gerber | 83/171 X |
| 5,046,251 | * | 9/1991 | Scott . | |
| 5,064,994 | * | 11/1991 | Urban | 83/171 X |
| 5,065,804 | * | 11/1991 | Kinuhata et al. | 83/171 X |
| 5,092,208 | * | 3/1992 | Rosa-Miranda | 83/171 |
| 5,308,311 | * | 5/1994 | Eggers et al. | 83/171 X |

FOREIGN PATENT DOCUMENTS

| | | | | |
|---|---|---|---|---|
| 2914401 | * | 10/1979 | (DE) | 219/233 |
| 436743 | * | 12/1974 | (SU) | 83/171 |

* cited by examiner

*Primary Examiner*—Kenneth E. Peterson

(57) ABSTRACT

A cutting blade for resistance-heated elastomer cutters generally comprising a cutting edge and supporting portion joined together. The cutting edge is made of material which possesses significantly higher electrical and thermal conductivity than the material composing the supporting portion. When electrical current flows through the cutting blade, significant portion of thermal energy is generated and concentrated in the cutting edge. The cutting edge is the part of the cutting blade most directly involved in cutting of elastomer material. The generation and concentration of thermal energy in the cutting edge results in more efficient and better quality cutting and reduces heat damage done to the cutting blade and material being cut.

1 Claim, 2 Drawing Sheets

CUTTING BLADE FOR RESISTANCE-HEATED ELASTOMER CUTTERS

BACKGROUND OF INVENTION

This invention relates to cutting or grooving of elastomers and like materials. More particularly, this invention relates to a cutting blade for resistance-heated cutters that allows for more efficient and better quality cutting.

It is known that resistance-heated cutters are widely used for cutting and grooving elastomers such as rubber. In a resistance-heated cutting process, electrical current from an external source is conducted through an electrically conductive cutting blade. Heat is generated in the cutting blade as an effect of resistance to electrical current flow.

Conventionally known electrically heated cutting blades, such as used in electrically heated tire groovers, are composed of a strip of electrically conductive material formed in a U-shape. In such prior art devices, the heat is not concentrated in the cutting edge of the blade, where it would be most effective in aiding the cutting of the material. Rather, just the opposite occurs during the cutting process, the cutting edge is cooled by the material being cut, and is the coolest part of the blade. Therefore, when sufficient heat is developed to maintain a favorable cutting edge temperature for optimum cutting performance, substantial excess heat is developed in the portions of the blade further from the cutting edge. This overheating causes severe damage and tends to reduce the life of the blade. The replacement of the burnt-out or heat damaged cutting blades is expensive and time consuming. The heat developed in portions of blade further away from the cutting edge also reduces the quality of cuts or grooves, produces undesired smoke by burning the elastomer, and transfers heat to other parts of the cutting assembly.

Thus, in Van Alstine, U.S. Pat. No. 4,797,999, there is disclosed a cutting head member allowing for rapid replacement means of the damaged cutting blades. This invention, however, does not address the problem of overheating of the parts of the blade away from the cutting edge.

In Wenger, U.S. Pat. No. 4,539,467, an electrically heated cutting tool is disclosed with means of airstream cooling of the parts of the blade away from the cutting region to reduce heat transfer to the blade holder and increase heat concentration in the cutting portion of the blade. Wenger's invention does not stop overheating of the blade, but only remedies it with cooling. Wenger also presents the disadvantage of requiring air supply means and is not energy efficient because a significant portion of heat energy is lost to the cooling system.

Another similar invention is disclosed in Lejuene, U.S. Pat. No. 3,850,222, where in order to concentrate thermal energy in the cutting zone, the cutting portion of the blade has a width that is significantly less than the width of the fastening zone so that the heating is greater in the cutting zone than fastening zone. Although this invention provides for means to concentrate the thermal energy in the cutting zone of the blade, the heat is not concentrated in the cutting edge of the blade. Therefore, the previously mentioned problems involved with overheating of the portions of the blade further away from the cutting edge are still likely to occur.

SUMMARY OF THE INVENTION

A primary object of this invention is to provide a cutting blade for resistance-heated elastomer cutters that greatly improves the efficiency and quality of elastomer cutting as compared to previously known devices.

The object is solved in accordance with the present invention, by a cutting blade that generates and concentrates most of the thermal energy in its cutting edge portion when electrical current flows through it.

The preferred embodiment facilitates a U-shaped cutting blade that can be shaped to accommodate a plurality of cutting and grooving operations. The disclosed cutting blade comprises two strips of different materials joined together edge-to-edge and formed in a U-shape. Alternatively, the two strips need not be joined together, but can simply be in a abutting relationship. Either way, the wider strip of material serves as support means for the narrower strip of material forming the cutting edge. The cutting edge is made of a material which preferably possesses significantly higher electrical and thermal conductivity than the supporting portion.

During the cutting process, the blade is placed in a convenient fixture. When electrical current from an external source flows through the cutting blade, the physical properties of the materials comprising the blade result in significantly greater generation of thermal energy in the cutting edge as compared with the remaining portion of the cutting blade. In the preferred embodiment, the cutting edge is sharpened which also facilitates more effective cutting.

In accordance with the present invention, the significant heat generation and concentration in the cutting edge of the cutting blade presents several advantages.

The life of the cutting blade is greatly increased because only the cutting edge, a relatively small portion of the cutting blade, is exposed to high cutting temperatures. Overheating of the rest of the blade is eliminated.

Another advantage of the present invention is increased energy efficiency of the resistance-heated cutting operation. Since significant thermal energy is generated only in a relatively small portion of the cutting blade, the amount of electrical energy required to generate that thermal energy is relatively small.

Yet another advantage of the present invention is increased quality of cuts or grooves made and reduction of undesired smoke produced during the cutting process. The concentration of heat in a relatively small portion of the cutting blade, namely the cutting edge, significantly eliminates heat damage done to the elastomer and smoke produced by burning of the elastomer during the cutting process.

Still further objects and advantages will become apparent from a consideration of the ensuing description and drawings.

DESCRIPTION OF THE PREFERRED EMBODIMENTS

Figure 1:
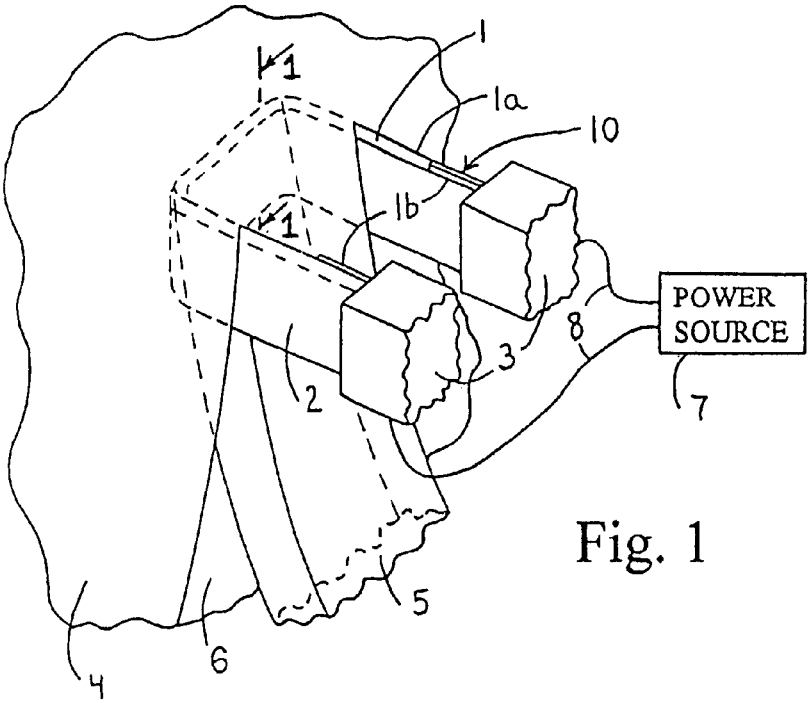
FIG. 1 is a partial perspective view of the preferred embodiment of the invention engaged in grooving operation.
Figure 2:
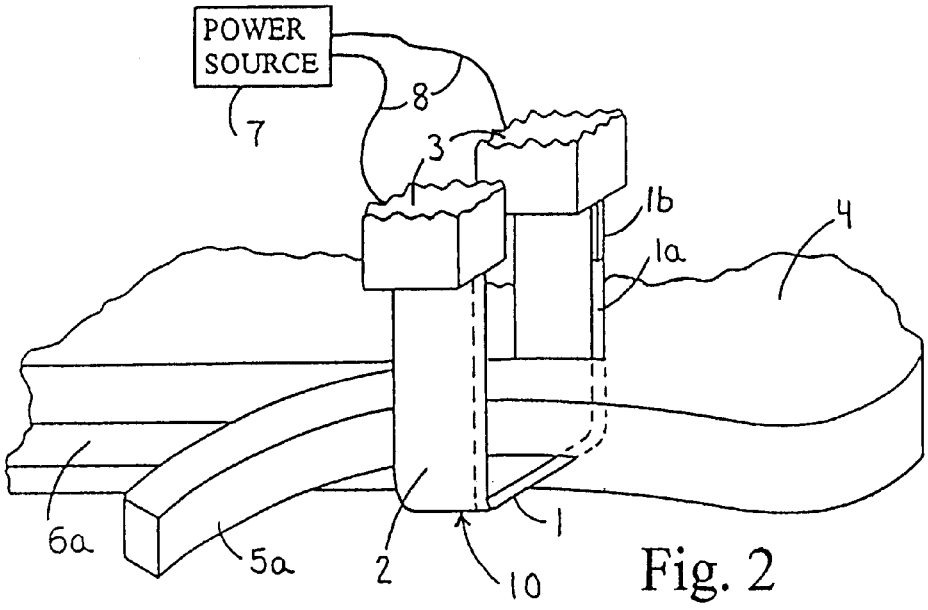
FIG. 2 is a partial perspective view of the preferred embodiment of the invention engaged in carving operation.

Viewing FIGS. 1 and 2, it will be seen that a preferred embodiment of the cutting blade 10 comprises generally of cutting edge 1 and supporting portion 2. The cutting edge 1 is sharpened to form a knife-like blade on the working portion 1*a*, as shown in FIG. 3.

Returning to FIGS. 1 and 2, the holding portions 1*b* of the cutting edge 1 are not sharpened to form a knife-like blade. Furthermore, the cutting edge 1 is made of a strip of material which possesses higher electrical and thermal conductivity than the supporting portion 2. The supporting portion 2 is significantly larger than the cutting edge 1 and serves as a support for the cutting edge 1. The supporting portion 2 and cutting edge 1 are joined together to form the U shaped cutting blade 10. The cutting blade 10 is placed in convenient fixture 3.

During the grooving or cutting operation electrical current from external power source 7 travels through conductors 8 connected to fixture 3. The fixture 3 is designed in such a way as to permit the supplied current to flow through the cutting blade 10. When electrical current flows through the cutting blade 10, the above mentioned physical properties of the materials composing the cutting edge 1 and supporting portion 2 result in significantly greater generation of thermal energy in the cutting edge 1 as compared with the supporting portion 2.

Figure 3:
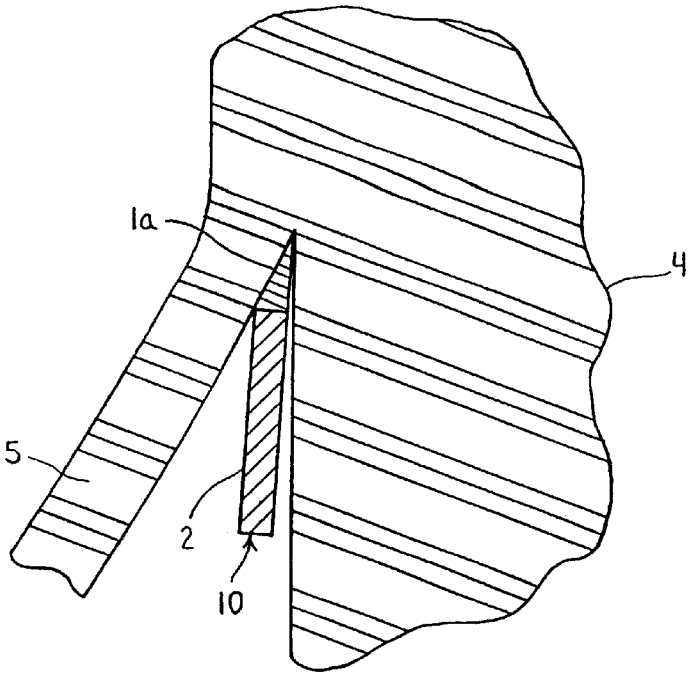
FIG. 3 is a enlarged partial sectioned view of the preferred embodiment of the invention, taken along section line 1—1 of FIG.1.

Continuing to view FIGS. 1 and 2 along with FIG. 3 it will be seen that the working portion 1*a* of cutting edge 1 is the part of the cutting blade 10 directly involved in cutting of material 4.

Now viewing more particularly FIG. 1, it will be seen how the preferred embodiment of the invention is used for grooving elastomer products. During the grooving operation, when electrical current flows through the cutting blade 10, force is applied to cutting blade 10 or material 4 or both. This causes blade 10 to penetrate material 4 producing grove 6 corresponding to the size and shape of the cutting blade 10 and produces a chip or shaving 5.

Referring more particularly to FIG. 2, it is shown how the preferred embodiment of the invention is used for carving elastomer products. The carving or trimming process as seen in FIG. 2 is similar to the grooving process in FIG. 1 except the cutting blade 10 is not fully in contact with material 4. In the cutting process the carving 6*a* and chip or shaving 5*a* are produced.

Figure 4:
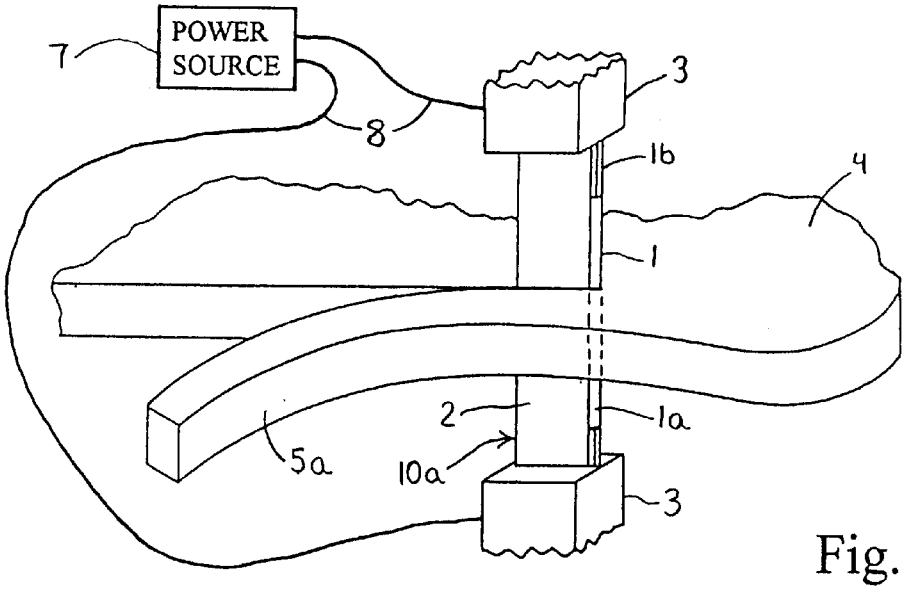
FIG. 4 is a partial perspective view of one alternative embodiment of the invention engaged in cutting operation.

Refer now to FIG. 4 where one alternative embodiment of the invention is shown engaged in cutting process. The alternative embodiment of cutting blade 10*a* comprises generally of cutting edge 1 and supporting portion 2. The cutting blade 10*a* differs only in general shape from the cutting blade 10 in FIGS. 1 and 2. One should refer to above description of parts of cutting blade 10 that correspond to parts of cutting blade 10*a*. With the exeption that cutting blade 10*a* is mostly suitable for cutting or trimming of material, the operation of cutting blade 10*a* is very similar to operation of cutting blade 10 and one should refer back to above description of operation of cutting blade 10. Cutting blade 10*a* as shown in FIG. 4 is intended to further show that the invention can be made in plurality of shapes and sizes as desired by working conditions.

What is claimed is:

1. A substantially U-shaped cutting blade for cutting elastomers, said substantially U-shaped cutting blade comprising:

a substantially U-shaped cutting edge made from a first strip of material having high electrical and thermal conductivity, said first strip having a first strip width extending from a first strip front to a first strip back, the first strip front being sharpened for contacting and cutting a workpiece, the first strip back having a thickness;

a substantially U-shaped supporting portion made from a second strip having a second strip width extending from a second strip front to a second strip back, said second strip width being larger than said first strip width and said second strip front being fixedly attached to first strip back to structurally support said first strip of said substantially U-shaped cutting edge, and said second strip front having a similar thickness to the thickness of the first strip back, and said first strip and second strip are aligned such that cut material will flow smoothly thru said U-shaped cutting blade;

an electrical power source electrically connected to said first strip of said substantially U-shaped cutting edge and to said second strip of said substantially U-shaped supporting portion for generating thermal energy to facilitate cutting, said second strip of material having electrical and thermal conductivity lower than said first strip such that most of said thermal energy is concentrated in said first strip.

* * * * *